US005247889A

United States Patent [19]

Luebbers

[11] Patent Number: 5,247,889

[45] Date of Patent: Sep. 28, 1993

[54] SUBCALIBRE CARTRIDGES FOR RECOILLESS TRAINING WEAPONS

[75] Inventor: Willi Luebbers, Rotenbek, Fed. Rep. of Germany

[73] Assignee: Nico-Pyrotechnik Hanns-Juergen Diederichs GmbH & Co., Trittau, Fed. Rep. of Germany

[21] Appl. No.: 861,818

[22] PCT Filed: Oct. 9, 1991

[86] PCT No.: PCT/DE91/00796

§ 371 Date: Aug. 7, 1992

§ 102(e) Date: Aug. 7, 1992

[87] PCT Pub. No.: WO92/07231

PCT Pub. Date: Apr. 30, 1992

[30] Foreign Application Priority Data

Oct. 10, 1990 [DE] Fed. Rep. of Germany ..... 4032177

[51] Int. Cl.[5] ..... F42B 8/12

[52] U.S. Cl. ..... 102/444; 89/1.701

[58] Field of Search ..... 89/1.701, 1.703, 1.706; 102/444, 456, 529, 465, 430

[56] References Cited

U.S. PATENT DOCUMENTS

| | | | |
|---|---|---|---|
| 3,815,469 | 6/1974 | Schubert et al. | 89/1.701 |
| 4,132,148 | 1/1979 | Meistring et al. | 89/1.701 |
| 4,406,209 | 9/1983 | Arene et al. | 89/1.701 |

FOREIGN PATENT DOCUMENTS

| | | |
|---|---|---|
| 0377433 | 7/1990 | European Pat. Off. . |
| 3421841 | 1/1986 | Fed. Rep. of Germany . |
| 954164 | 12/1949 | France . |
| 2194940 | 3/1974 | France . |
| 2290640 | 6/1976 | France . |
| 365973 | 1/1963 | Switzerland . |
| 2121933 | 1/1984 | United Kingdom . |

*Primary Examiner*—David H. Brown

*Attorney, Agent, or Firm*—Sprung Horn Kramer & Woods

[57] ABSTRACT

The invention relates to a subcalibre cartridge (1) for recoilless training weapons, whereby a counter-mass (10) is expelled with a cover or end cup (11) from a closed charge case (14) when the practice round is fired. To ensure certain tearing of the end cup, to even out the recoil at the same time and to reduce the safety area behind the training weapon, the bottom of the end cup (11) is provided with an opening which is covered with a foil (16, 17) that tears when the counter-mass is expelled. Self-adhesive aluminum foils are preferably used for this purpose.

12 Claims, 2 Drawing Sheets

SUBCALIBRE CARTRIDGES FOR RECOILLESS TRAINING WEAPONS

BACKGROUND OF THE INVENTION

The invention relates to a cartridge for recoilless training weapons, more particularly to a training bullet contained in a cartridge case and having a closed charge case connected to the cartridge case and fitted with an end cup at the back to enclose a spotting charge and a counter-mass to be expelled from the charge case.

Such a training cartridge is known from the German patent publication No. DE-OS 34 21 841. The training cartridge is fired from a modified training weapon otherwise used for anti-tank defense and consists of a subcalibre practice round contained in a cartridge case and, in diameter, a larger charge case linked to it, in which a charge, the so-called spotting charge, is stored to expel a counter-mass, whereby the spotting charge is ignited when firing the practice round. Glass sand is used as the counter-mass, where necessary with a low proportion of a lubricant such as zinc stearate.

The charge case is closed off at the back end by a cover, the so-called end cup. This cup is, for example, formed from thin aluminium sheet and has a running edge which borders with the back end of the charge case One problem when firing such practice rounds is that the end cup is deformed by the shock wave of the spotting charge before the dish and counter-mass are blasted backwards out of the charge case. What can happen is that at least one part of the counter-mass clots in the deformed case, quasi forming a cup, and together they are almost fired like a bullet out of the training weapon into the open. This clotting of the counter-mass occurs on the one hand in a relatively wide dispersing angle area up to 120° and moreover with such force that a 1 mm thick grey board is penetrated at a distance of 20 m. This is unacceptable for safety reasons, due to the increased risk of injury to persons standing behind the training weapon.

To find a solution, it was proposed to provide the end cup with predetermined breaking points, e.g. in the form of material dilution starting from the centre either radially or star-shaped. It is, however, difficult in manufacturing terms to guarantee a tearing of the predetermined breaking point with a defined force. Moreover, the tearing force of the predetermined breaking point is temperature-dependent, the slighter the higher the temperature. This has several consequences:

If the predetermined breaking point tears unevenly on firing, for instance, due to existing production inaccuracies, this can have repercussions on the shock wave of the spotting charge within the charge case and a certain proportion of the pressure forces is directed at the wall of the charge case so that parts of the counter-mass are pressed more forcibly against the wall. As a result of the increased friction between the wall and the counter-mass, there is increased side abrasion and, consequently, undesired different recoil forces.

If the predetermined breaking point is so designed that the practice round passes a drop test, in which the practice round is dropped onto a hard surface from a height of 2 m and is not damaged at temperatures up to +60° C.--in particular the predetermined breaking point of the end cup must not tear--then the danger is that the predetermined breaking point does not tear or does not do so at the correct moment during firing at −40° C., so that undesired high recoils occur. If the predetermined breaking point, on the other hand, is so designed that it will definitely tear at low temperatures, then the danger exists that it will not pass the drop test when warm.

Apart from that, a certain cup shaping of the dish or parts of it can occur in this formation of the end cup with predetermined breaking points, and thus clot formation of the counter-mass cannot be completely prevented.

SUMMARY OF THE INVENTION

The invention is based on the objective of so modifying the end cup of a practice round under discussion that the end cup always tears when firing occurs, preventing clot formation of the counter-mass, and evens out the recoil and reduces the safety zone behind the training weapon, yet on the other hand the prescribed drop test can be passed in the whole temperature range.

The surprisingly simple concept behind the invention consists of making the floor of the end cup, or a considerable part of it, out of foil. For this purpose commercial metal foils, for instance 50 μm thick aluminium foils, can be used which already have a bonding layer. Preferably two such aluminium foils are bonded to both sides of a support structure for the end cup, e.g. on both sides of a simple ring flange with an L-shaped profile so that the foils stick to one another in the vicinity of the openings of the support structure or the opening of the ring flange.

The foil used must have a certain tensile strength as well as a certain elasticity so that the above-mentioned drop-test can be passed with certainty across the whole temperature range when using the training weapon and so that the foil will tear reliably when fired.

By using a foil or a double foil made of two bonded foils, cup formation of the end cup and hence clot formation of the counter-mass is definitely prevented. Moreover, due to the rapid tearing of the foil on firing, there is scarcely any reaction on the shape of the shock front in the charge case. Only slight forces occur here, directed at the wall of the charge case, so that the friction between the charge case and the counter-mass is small and the counter-mass is only expelled backwards in a quite small reproducible angle area of just 10 degrees.

With this measure in accordance with the invention, the recoil is practically the same for each shot.

Moreover, the area behind the training weapon becomes considerably smaller in which damage to material or injuries have to be feared. No damage at a distance of more than 60 cm from the axis of the bore of the training weapon was determined for test shots on a 1 mm thick grey board which was set up about 4 m behind the training weapon.

A further advantage of the invention is that the end cup itself is so light that, if it is hurled out backwards by the counter-mass it, does not act as a "projectile". In such a case, the end cup falls to the ground after only a few meters due to the air turbulence.

The invention is explained in implementation examples in greater detail using the drawing.

DESCRIPTION OF THE PREFERRED EMBODIMENTS

Figure 1:
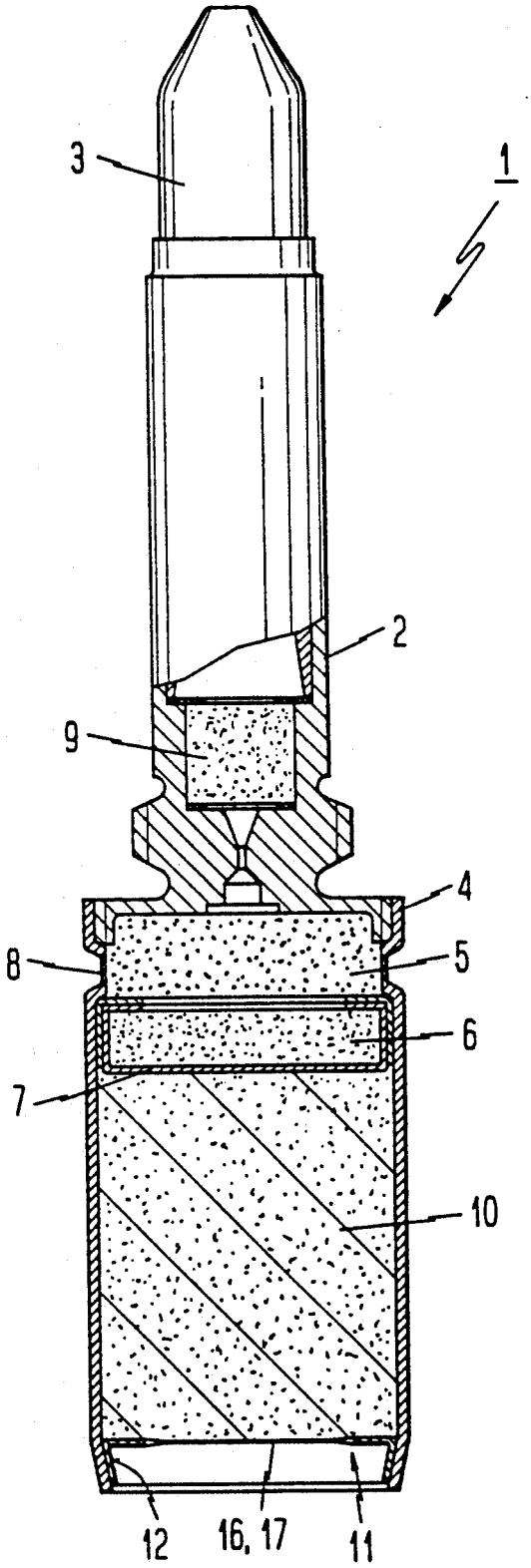
FIG. 1 is a view of the training cartridge, partially in longitudinal section, in accordance with the invention.

In FIG. 1 a practice 1 round is shown consisting of a cartridge case 2, a training bullet 3 contained in it and a charge case 4 screwed to the end of the of the cartridge case. In this charge case 4 are front and rear spotting charges 5 and 6 envisaged, whereby the rear spotting charge 6 is closed off by a cover 7 or dish. In the vicinity of the front spotting charge 5, there is an ignition notch 8 which is pierced when the practice round is fired from a training weapon by an impact, e.g. a bullet, whereby the front spotting charge is ignited. The hot gases of this spotting charge ignite on the one hand a propellant charge 9 by means of which the practice round is fired out of the cartridge case and, on the other hand, the rear spotting charge reacts on a counter-mass of glass sand. The glass sand 10 fills the remainder of the charge case 4 which is closed off at the rear end by an end cup 11. This end cup 11 has a lateral running edge 12 going to the rear which borders with the rear end of the charge case 4.

Figure 2:
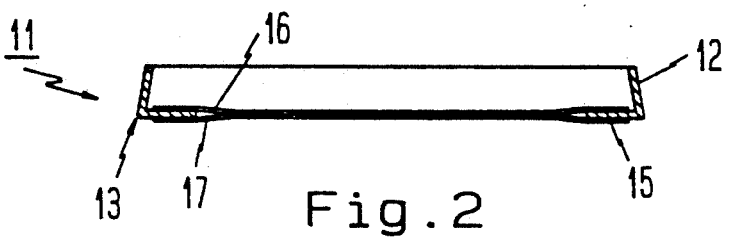
FIG. 2 is a cross-section through an end cup through a cartridge cartridge of the training case
Figure 3:
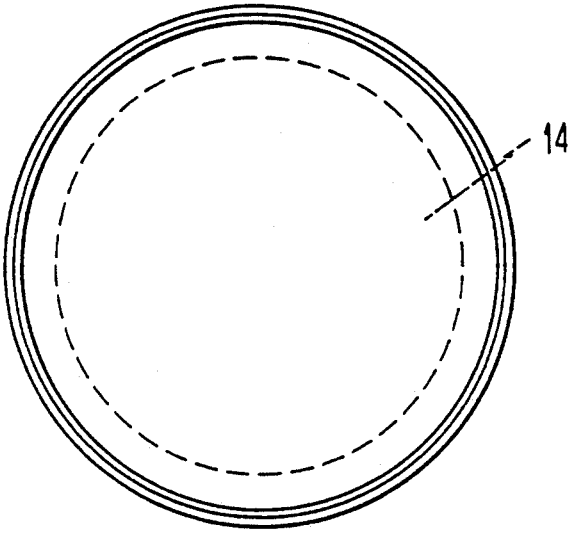
FIG. 3 is a top view of the end cup in accordance with FIG. 2.

As is clear from FIGS. 2 and 3, the end cup 11 is a ring flange with an L-shaped profile 13 in cross-section and a central opening. The profile webs of the ring flange 13 are on the one hand the above-mentioned edge 12 and on the other hand a running, inward directed web 15, the inner rim of which limits the central opening. An aluminium foil 16 and 17 is stuck to the upper and lower sides respectively of this running web 15. These two foils cover the central opening and are bonded to one another in this area.

After the spotting charge 6 has been ignited, the foils 16 and 17 of the end cup are torn by the shock wave within the counter-mass 10 whereby the counter-mass 10 is also expelled backwards from the charge case by the dish being propelled forward. By using the additional dish 7 a homogenizing of the recoil is achieved.

Figure 4:
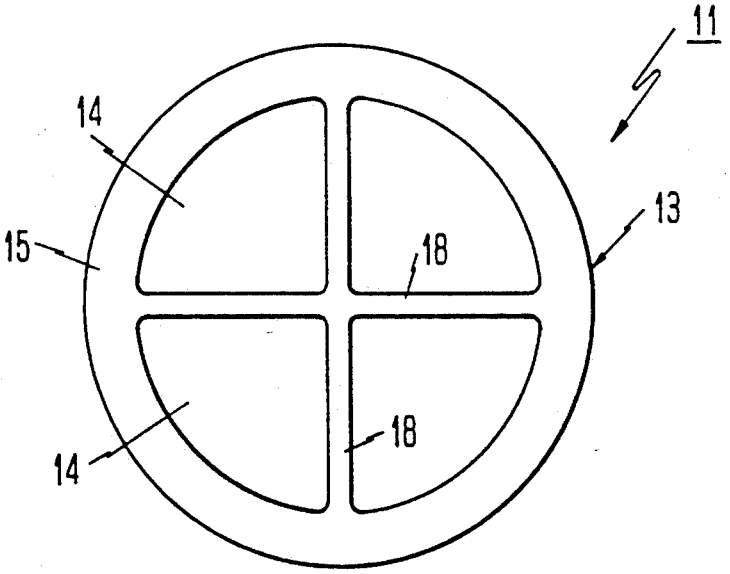
FIG. 4 is an alternative design for an end cup in accordance with a further form of the invention.

In FIG. 4 a modified construction of an end cup 11 is shown. The end cup also has an L-shaped ring flange 13 in cross-section, whereby cross-struts 18 are envisaged on the level of the inward directed profile web 15 so that the central opening 14 of the ring flange in this instance is sub-divided into four quadrant openings. To this design the aluminum foil is bonded to both sides of the profile web 15 and cross-struts 18, as is described for FIGS. 2 and 3.

A self-adhesive foil can be used as the aluminium foil. This already has a bonding layer with a protective cover to be removed before use. The thickness of these foils is preferably between 50 μm and 150 μm.

There has thus been shown and described a novel subcalibre cartridge for recoilless training weapons which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart form the spirit and scope of the invention are deemed to be covered by the invention, which is to be limited only by the claims which follow.

I claim:

1. In a subcalibre cartridge for a recoilless training weapon consisting of a training bullet contained in a cartridge case and a closed charge case connected to the cartridge case and fitted with an end cup at the back to enclose a spotting charge and a counter-mass to be expelled from the charge case; the improvement wherein the bottom of the end cup (11) has at least one opening which is covered by a foil that tears when the counter-mass (10) is expelled.

2. A cartridge in accordance with claim 1, wherein the end cup (11) only has one opening (14).

3. A cartridge in accordance with claim 1, wherein the end cup (11) has several openings (14).

4. A cartridge in accordance with claim 1, wherein the foil (16, 17) is bonded to the end cup (11).

5. A cartridge in accordance with claim 1, wherein the foil is a double foil made up of two foils (16, 17) which are connected to one another in the vicinity of at least one opening (14) of the end cup (11).

6. A cartridge in accordance with claim 1, wherein the end cup (11) has a ring flange (13) having an L shaped profile with two profile webs, whereby one profile web (13) is flush to the edge of the end cup at the inner wall of the charge cover (4) and the other profile web is vertical to the outer wall of the charge cover (4) and wherein on each side of the second profile web (15) a covering foil (16, 17) is bonded to the central opening (14) of the flange (13) and the two foils (16, 17) are bonded to one another in the vicinity of the central opening (14).

7. A cartridge in accordance with claim 1, wherein a spotting charge (6) in the charge cover (4) is separated from insulation therein (10) by a cylinder-like cover (7).

8. A cartridge in accordance with claim 1, wherein the end cup (11) consists of a ring flange (13) connected by a flange web to the charge case and a foil (16, 17) in the bottom of the end cup (11).

9. A cartridge in accordance with claim 8, wherein the ring flange (13) has an L-shaped profile in cross-section.

10. A cartridge in accordance with claim 1, wherein the foil (16, 17) is an aluminum foil.

11. A cartridge in accordance with claim 10, wherein the aluminum foil (16, 17) is a self-adhesive foil.

12. A cartridge in accordance claim 10, wherein the aluminum foil (16, 17) has a thickness of between 50 and 150 μm.

* * * * *